United States Patent [19]

Braun

[11] Patent Number: 4,896,632

[45] Date of Patent: Jan. 30, 1990

[54] UNSYMMETRICAL FREE PISTON ENGINE

[76] Inventor: Anton Braun, 6421 Warren Ave., S., Minneapolis, Minn. 55435

[21] Appl. No.: 786,067

[22] Filed: Oct. 10, 1985

[51] Int. Cl.[4] ..... F02B 71/00

[52] U.S. Cl. ..... 123/46 R; 123/46 B

[58] Field of Search ..... 123/46 R, 46 A, 46 B

[56] References Cited

U.S. PATENT DOCUMENTS

| | | | |
|---|---|---|---|
| 2,027,877 | 1/1936 | Pescara | 123/46 R |
| 3,183,900 | 5/1965 | Hellweg | 123/46 R |
| 3,524,436 | 8/1970 | Braun | 123/46 R |
| 3,525,102 | 8/1970 | Braun | 123/46 R |
| 3,610,214 | 10/1971 | Braun | 123/46 A |
| 4,085,711 | 4/1978 | Braun | 123/46 B |

FOREIGN PATENT DOCUMENTS

| | | | |
|---|---|---|---|
| 447099 | 7/1927 | Fed. Rep. of Germany | 123/46 R |

*Primary Examiner*—Craig R. Feinberg

*Attorney, Agent, or Firm*—Alan M. Staubly

[57] ABSTRACT

A compact free piston engine of the unsymmetrical type including a structure with a cylinder detachably supported therein, said cylinder having a pair of pistons with a combustion chamber therebetween and each piston having a rod extending through the adjacent end of the cylinder and having motion reversing means at one end of said cylinder and extending between said rods. Preferably, the structure is of strong but lightweight construction. It may have a skeleton type of housing with bolt type columns spaced around the cylinder. Portions of the reversing means lie along the side of the cylinder while another major portion thereof lies beyond one end of the cylinder. An energy absorbing device or devices may be connected to one only or to each of the rods, and each rod will be driven simultaneously in an opposite direction to the other by both pistons.

10 Claims, 1 Drawing Sheet

UNSYMMETRICAL FREE PISTON ENGINE

SUMMARY

This invention relates to an improved combination of basically old elements in free piston engines, such as shown in the inventor's U.S. Pat. No. 3,524,436. The new combination makes it possible to reduce the overall weihgt of the engine by providing a light weight cylinder supporting structure and reducing the size thereof as compared with prior art engines of equal horsepower.

The invention lies in a compact free piston engine of the unsymmetrical type having a pair of co-axial pistons in a cylinder, including a motion reversing mechanism serving both as a synchronizing and a driving mechanism for an energy absorbing device. The speed of the engine is greatly increased over what is accomplished in prior art engines. This provides a highly efficient and compact linear engine that permits the driving mechanism to be external of the engine cylinder, to have less weight and cost and to not require a heavy housing construction. The invention further provides for a less weight entire engine by detachably supporting the cylinder at one end only in a skeleton type structure which also renders the cylinder or a liner therein, less subject to deforming stresses.

DRAWINGS

The preferred embodiments of the invention are schematically illustrated in the drawing wherein.

DESCRIPTION

Figure 1:
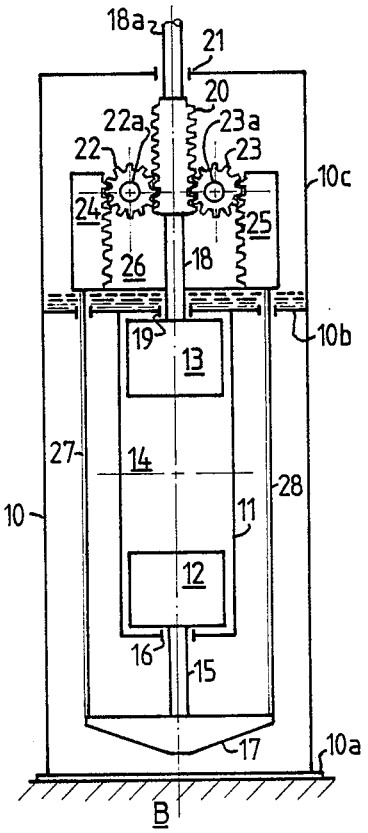
FIG. 1 is a vertical sectional view of one embodiment of the invention.

The principal arrangement, in FIG. 1, has a light weight support or housing 10, preferably of skeleton type construction and adapted to be mounted on a base B with the longitudinal axis of the housing extending vertically. A cylinder 11, which is preferably coaxial with the housing, is suitably suspended at its upper end on an upper end wall 10*b* of said housing.

First and second pistons 12 and 13 in the cylinder have a conventional combustion chamber 14 therebetween. Piston 12 has a piston rod 15 extending througha bearing 16 in one end of the cylinder and carries a yoke 17 at its outer end. Piston 13 has a piston rod 18 extending through a bearing or seal 19 in the other end of the cylinder and carries a double rack 20 and a piston rod extension 18*a* which, in turn, extends through a bearing or seal 21 in the upper end of the housing.

Pinion gears 22 and 23 are mounted on fixed shafts 22a and 23*a* on opposite sides of the double rack 20 and engage opposite sides of the double rack. The shafts may be mounted on the upper end wall 10b of the cylinder. A pair of spaced racks 24 and 25 engage gears 22 and 23, respectively, and are rigidly connected by a pair of plates 26 (one shown) with the gears 22 and 23 therebetween. Racks 24 and 25 are connected to the yoke 17 by a pair of symmetrically located rods 27 and 28 lying between the cylinder and the housing structure. Oil is sealed in an upper portion 10*c* of the housing. It is to be understood that the yoke could be a compressor piston, scavenge piston or bounce piston.

OPERATION

With the engine connected to an energy absorbing device, such as a compressor with a piston having a weight which, when coupled with the weights of connecting elements 18*a*, 20, 18 and 13 of the engine, equals the combined weights of the oppositely moving weights 24, 25, 26, 27, 28, 17, 15, and 12, the engine will operate in a highly efficient and substantially vibration free manner. The engine is started by suitable conventional means that introduces fuel and air into the chamber 14, drives the pistons toward the center of the cylinder and then ignites the fuel-air mixture. Outward movement of the pistons 12 and 13 causes tension to pull the reversing racks so as to drive gears 22 and 23 to move double rack 20 in the same direction as does piston 13.

Figure 2:
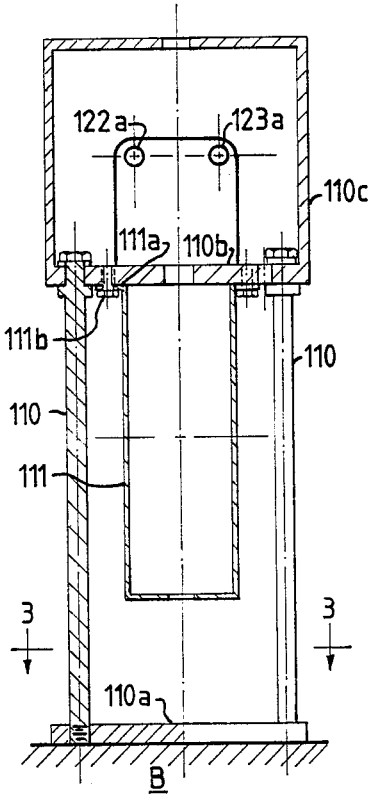
FIG. 2 is a similar view of the cylinder supporting structure only of another embodiment of the invention.
Figure 3:
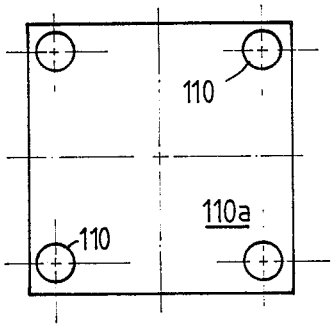
FIG. 3 is a sectional view of the embodiment of FIG. 2, along line 3—3 of FIG. 2.

The modification of FIGS. 2 and 3 differs from the Figil engine in that it is a more detailed showing of the cylinder and its supporting structure. Spaced rods or bolts 110 are screw threaded into base 110*a* and bolted at their upper end to support plate 110*b*, replacing the skeleton type of housing 10 of FIG. 1. This construction can be of less weight and less manufacturing cost and more suitable than that of FIG. 1 for applying sound insulating material around the cylinder, if desired. Also, the bolts may be replaced by other structural elements serving the same function.

The operation of the modification of FIGS. 2 and 3 is the same as that of FIG. 1. The rods provide the same supporting function for the cylinder as the housing 10.

Figure 4:
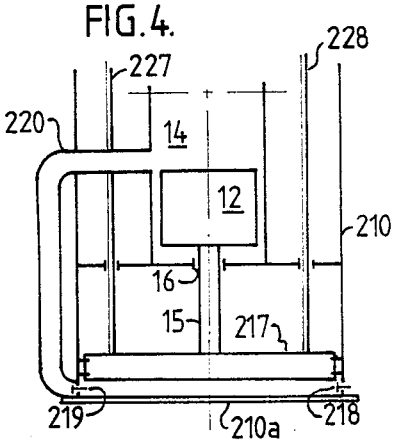
FIG. 4 is a fragmentary view of a modified lower end of the engine of FIG. 1.

The embodiment of FIG. 4 is the same as FIG. 1 except for the substitution of a compressor piston 217 in a scavenge air cylinder 210 for the yoke 17 in FIG. 1. The scavenge air chamber has an inlet check valve 218 and an outlet check valve 219 for delivering scavenge air to the combustion chamber 14 through a conduit 220. However, the piston 217 also serves as a yoke to actuate the spaced racks of the reversing mechanism.

The operation of the embodiment of FIG. 4 is otherwise the same as that of FIG. 1.

Figure 5:
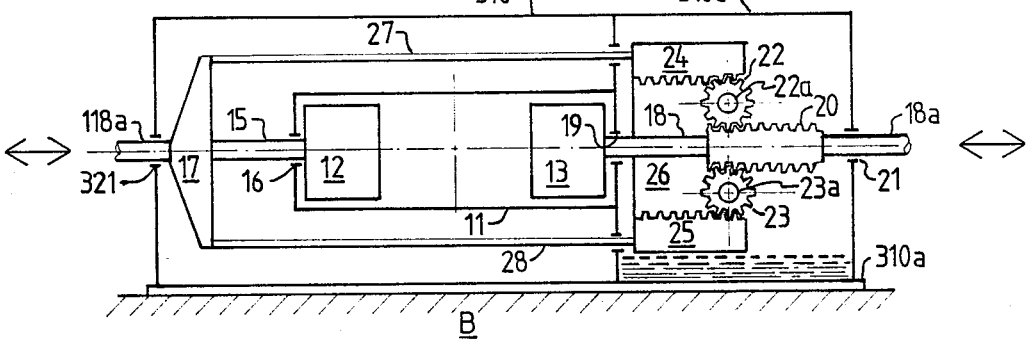
FIG. 5 is still another modification of the invention suitable for horizontal mounting.

The embodiment of FIG. 5 is the same as that of FIG. 1 except for being adapted to be mounted horizontally on its supporting base 310*a* and having a drive shaft 18*a* and 118*a* extending, respectively, out of opposite ends of the housing 210. This arrangement enables the drive shaft at one end to, for example, actuate a first stage compressor piston and a third stage compressor piston and the other drive shaft to simultaneously actuate a second stage compressor piston and a fourth stage compressor piston and have the various units driven by the engine readily assembled and accessable or disassembled for servicing.

Here, again, the operation of the engine in FIG. 5 is the same as that of FIG. 1.

Another modification, for example, is one wherein a plurality of cylinder and driving mechanism assemblies are suspended from a single support structure with a common enclosure which results in a machine of substantially less cost and weight and small size. Also, it provides a common set of auxiliary equipment and accessories for all cylinders, such as, for example in a six cylinder version of such a multi-cylinder unit, only one common cooling system and a single starting unit in place of six individual ones. An obvious advantage of such a multistage cylinder unit over a crank-driven equivalent is that in the crank type multicylinder engine, even if only one cylinder is defective, the whole engine is incapacitated, whereas if any one or more of the cylinders in a multicylinder unit of the present invention fails, all of the remaining cylinders will still by full available. This feature also makes it possible to schedule sequential servicing of the individual cylinders to increase the availability of such a machine to practically 100%.

CONCLUSION

From the foregoing, it is apparent that this invention is a substantial improvement over the numerous prior art engines in this field in that it provides a quiet, compact, lightweight, inexpensive, efficient and substantially vibration free engine, that may be easily assembled, disassembled and serviced and has great versatility. It is also easily adapted to operate various energy absorbing devices without major changes in the basec design.

I claim:

1. A compact and substantially vibration free engine of the unsymmetrical free piston type for driving a compressor or other energy absorbing device comprising: a cylinder, support means for supportingo ne end only of said cylinder, first and second pistons in said cylinder with a combustion chamber therebetween, the first piston having a first rod extending through a first end of said cylinder, the second piston having a second rod extending through a second end of said cylinder and having a double rack thereon beyond said second cylinder end, a pair of spaced pinion gears beyond said second end with one each engaging one side each of said double rack, a pair of spaced and rigidly connected racks having one each of the connected racks engaging one each of said pinion gears, a drive shaft extending from one of said first or second rods for driving an energy absorbing device, and drive means located along the side of the cylinder and extending from said spaced racks to the rod beyond the opposite cylinder end so that as said pistons move apart each will exert a force on said drive shaft in the same direction.

2. An engine as defined in claim 1 wherein said drive means is symmetrical with respect to the axes of said first and second rods.

3. An engine as defined in claim 1 wherein the total mass of one of said pistons and the elements connected thereto and movable therewith equal the total mass of the drive shaft and the piston and other elements connected thereto minus the mass of the energy absorbing device to be moved thereby.

4. An engine as defined in claim 1 wherein the longitudinal axes of said cylinder and support means are substantially coaxial.

5. An engine as defined in claim 1 wherein said support means is in the form of a skeleton type of housing.

6. An engine as defined in claim 1 wherein said support means includes a plurality of structural members spaced around said cylinder.

7. An engine as defined in claim 1 wherein said drive shaft is an extension of said second rod beyond said double rack.

8. An engine as defined in claim 7 wherein a second drive shaft extends from the other of said rods beyond said yoke.

9. An engine as defined in claim 1 wherein said support means is located at least partially around said cylinder and includes a wall extending transversely with respect to the axis of the cylinder and to which said one end of said cylinder is secured.

10. An engine as defined in claim 9 wherein a plurality of said cylinder, pistons and driving means are supported from said wall.

* * * * *